US006378226B1

(12) United States Patent
Fleissner

(10) Patent No.: US 6,378,226 B1
(45) Date of Patent: Apr. 30, 2002

(54) SCREEN DRUM FOR DRYING PERMEABLE WEBS OF GOODS

(76) Inventor: Gerold Fleissner, Bahnhofstr. 2, CH-6300 Zug (CH)

( * ) Notice: Subject to any disclaimer, the term of this patent is extended or adjusted under 35 U.S.C. 154(b) by 0 days.

(21) Appl. No.: 09/561,964

(22) Filed: May 1, 2000

(30) Foreign Application Priority Data

Apr. 29, 1999 (DE) ..... 199 19 757

(51) Int. Cl.[7] ..... D06B 5/08

(52) U.S. Cl. ..... 34/114; 34/115; 34/122; 34/139; 68/5 D; 68/158; 68/903

(58) Field of Search ..... 34/114, 115, 122, 34/130, 139, 210, 218; 68/5 D, 158, 903

(56) References Cited

U.S. PATENT DOCUMENTS 4,481,722 A * 11/1984 Guy et al. ..... 34/115
4,592,943 A * 6/1986 Cancian et al. ..... 428/156
5,570,594 A * 11/1996 Fleissner ..... 34/123
5,625,962 A * 5/1997 Fleissner ..... 34/446
5,678,321 A * 10/1997 Deshpande et al. ..... 34/114

* cited by examiner

*Primary Examiner*—Jiping Lu
(74) *Attorney, Agent, or Firm*—Antonelli, Terry, Stout & Kraus, LLP

(57) ABSTRACT

Each screen drum design has, in front of the rotating screen drum which transports the web, a stationary screen cover whose purpose is retention of the dry air coming from the fan, uniform throughput of the air through the screen cover, and a uniform drying process over the width of the web. The screen cover has a perforation whose permeability is adapted to the degree of drying. At the beginning of the drying process, when the web is not yet very permeably, the screen cover is to be perforated provided a smaller free air throughput surface and, as the degree of dryness increases, a larger free air throughput surface by making the holes larger in diameter or provided a larger number of holes per unit surface.

9 Claims, 4 Drawing Sheets

SCREEN DRUM FOR DRYING PERMEABLE WEBS OF GOODS

BACKGROUND OF THE INVENTION

The invention relates to a screen drum device for drying permeable webs of goods, especially textiles such as woven fabrics, knitted fabrics, tissue, nonwoven fabrics and the like in a housing having at least one rotatably mounted screen drum with a corresponding pumping device, such as a fan, at the front end which suctions off the gaseous drying medium from the inside of the screen drum and adds it back to the screen drum from the outside, said screen drum being associated with, on the outside, a stationary screen cover or a fixed cylindrical, screen body for equalizing the flow of the oncoming drying medium.

Screen drum dryers are known in various designs. The normal design is based on the registered utility model G 87 00 837, for example, according to which four screen drums are arranged in series next to each other, and a screen cover extends in a straight line above and below this row. The fans of each screen drum blow upward as well as downward, so that the recirculated air, after flowing through the screen covers, is also fed to the adjoining screen drums. The screen covers can also be bent centrally around the drums as shown in DE-A-39 05 001.

In addition to the bank of screen drums, dryers with only one screen drum are also known. There is, for instance, the design according to DE-A-43 25 915 with a screen cover arranged at an angle or, according to DE-A-30 06 758, with several screen drums in a device with screen covers arranged as segments of a circle or, according to DE-A-21 18 488, with a precisely centered screen cover on a device having, again, only one screen drum.

The best hole dimensioning, i.e., the optimum air permeability of the screen cover, is defined based on experience. Of importance is the uniform air supply to be achieved via the screen cover, which air supply is the prerequisite for the required temperature uniformity across the working width. It is known that the air permeability of the web of material is a function of the degree of moisture of the web. For clarification, one can refer to FIG. 5 in which several curves are entered of webs having varying degrees of moisture. This shows the increasing air permeability v(m/s) at varying pressure differences $\Delta p$ (mm water column) measured at the material.

Figure 6:
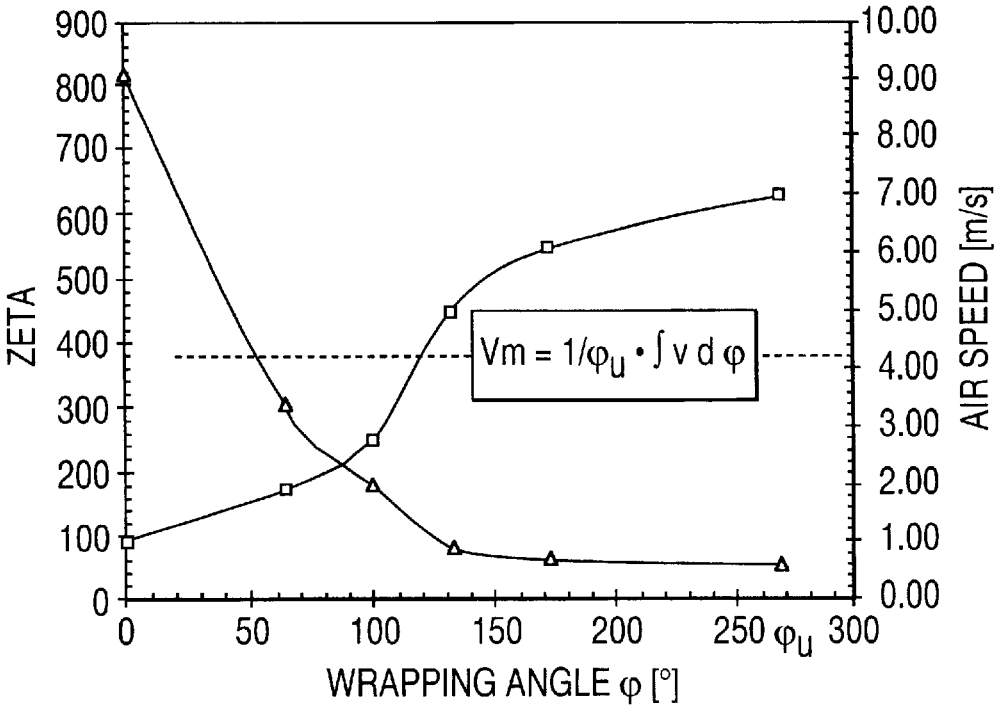

FIG. 6 is even more informative. There, the constant $\zeta$ from Bernoulli's loss equation $\Delta p=\zeta \times p/2 \times v^2$ is plotted against angle $\phi$ at the screen drum (drying angle on the single-drum device). This constant $\zeta$ drops with increasing degrees of dryness. In the same way, the air speed v (m/s) through the material rises with increasing angle $\phi$ at the drum. These physical data are known, but are not taken into consideration in the design of the hood surrounding the screen drum.

BRIEF SUMMARY OF THE INVENTION

The goal of the invention is to optimize the known screen drum dryer. An attempt is to be made to take into consideration the fact of the poorer air permeability of the wet material and also the improved air permeability of the drier material during the drying process and/or in the hood design.

In order to achieve is goal, it is suggested to provide the screen cover—as seen along its length in the housing in the direction of transport of the textile goods—with a perforation whose open spaces per unit area increase directly with the degree of dryness of the textile goods to be dried.

Figure 7:
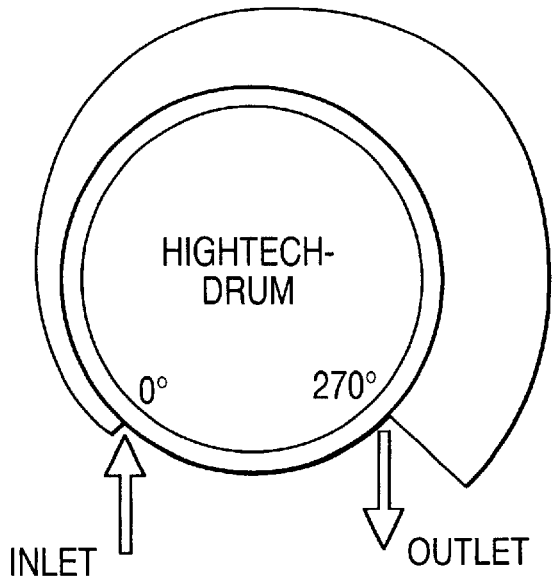

With this design alone of the screen plate surrounding the screen drum inside the hood, the supply of drying air to every point of the rotating screen drum is quantitatively regulated in such a way that the air made available and distributed evenly around the screen drum in front of the screen plate by the fan can actually penetrate the goods at the respective points of the actual drying phase. FIG. 7 shows the actual air speed v through the material as a function of the drying phase. The design of the screen cover makes possible optimization of the maximum achievable air speed through the material as a function of the wrapping angle 0° at the circumference at the inlet up to 270° at the outlet of the goods as a function of dryness.

The screen drum system has the advantage that in the drum (exhaust) as well as in the hood (supply), constant pressure conditions prevail, i.e. independent of the wrapping angle at the circumference of the drum. Because of the measure according to the invention, there no longer exists the danger of drawing air into or blowing air out of the hood due to local negative air pressure (deficiency of air) or local excess air pressure (excess air). This can occur if, at the inlet of the screen drum dryer, the air uniformly supplied by the fan cannot penetrate the wet goods and therefore has to escape through the opening between the rotating screen drum and the screen plate as secondary air. The reverse is then true at the outlet of the entire screen drum structure, where the goods are more permeable to air based on their dryness, and the negative pressure in the screen drum is so great that it must draw in air through the above-defined opening in addition to the available drying air. Due to this fact, an undesirable air flow can also be created in the direction of the circumference of the drum, which is thus prevented. Another very important advantage of these measures according to the invention is the improved energy utilization.

The design of the screen plate can take on different forms. It is advantageous if the perforation holes across the surface of the screen cover maintain a constant diameter, but the distance between the holes becomes smaller with the increasing degree of dryness of the textile goods to be dried.

Since, over the length of the screen plate and the extent of the drying process, the screen plate, for economic reasons, cannot be continuously perforated with varying intervals, it makes sense to partition the screen cover over the length of the device into individual segments and to install in each segment a screen cover with a constant, free air throughput cross section, except perhaps for the subsequent screen cover segment—in the transport direction of the textile goods—which would be provided with a larger air throughput cross section. The same goal can also be achieved with two parallel screen plates, displaceable relative to each other.

BRIEF DESCRIPTION OF THE SEVERAL VIEWS OF DRAWINGS

Figure 1:
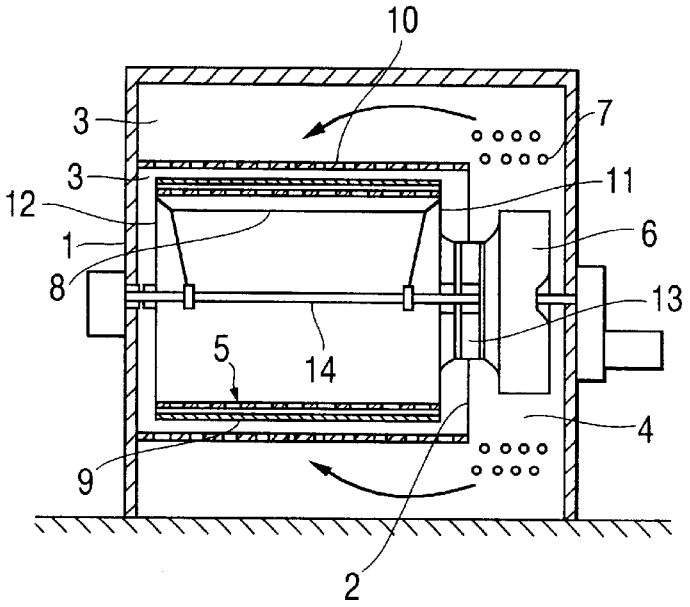
FIG. 1 (PRIOR ART)
Figure 2:
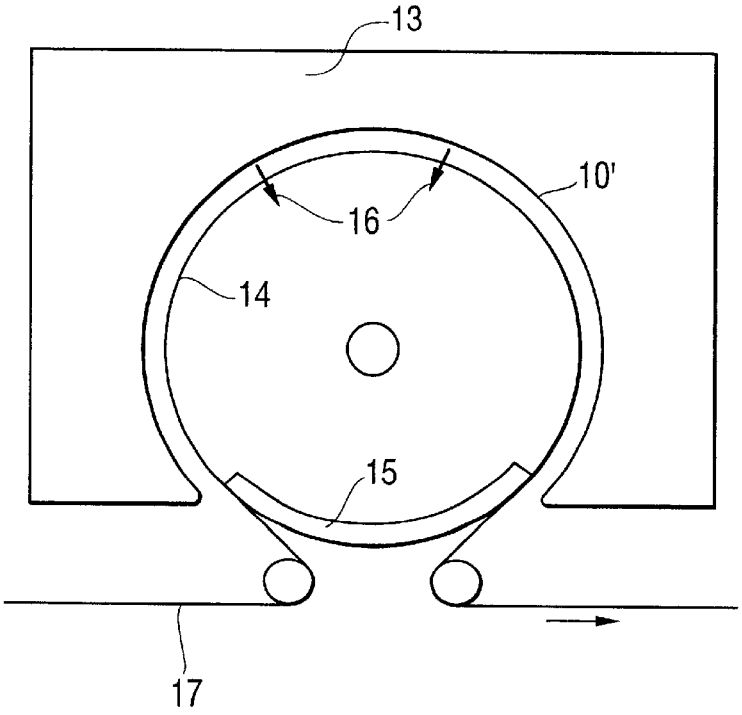
Figure 3:
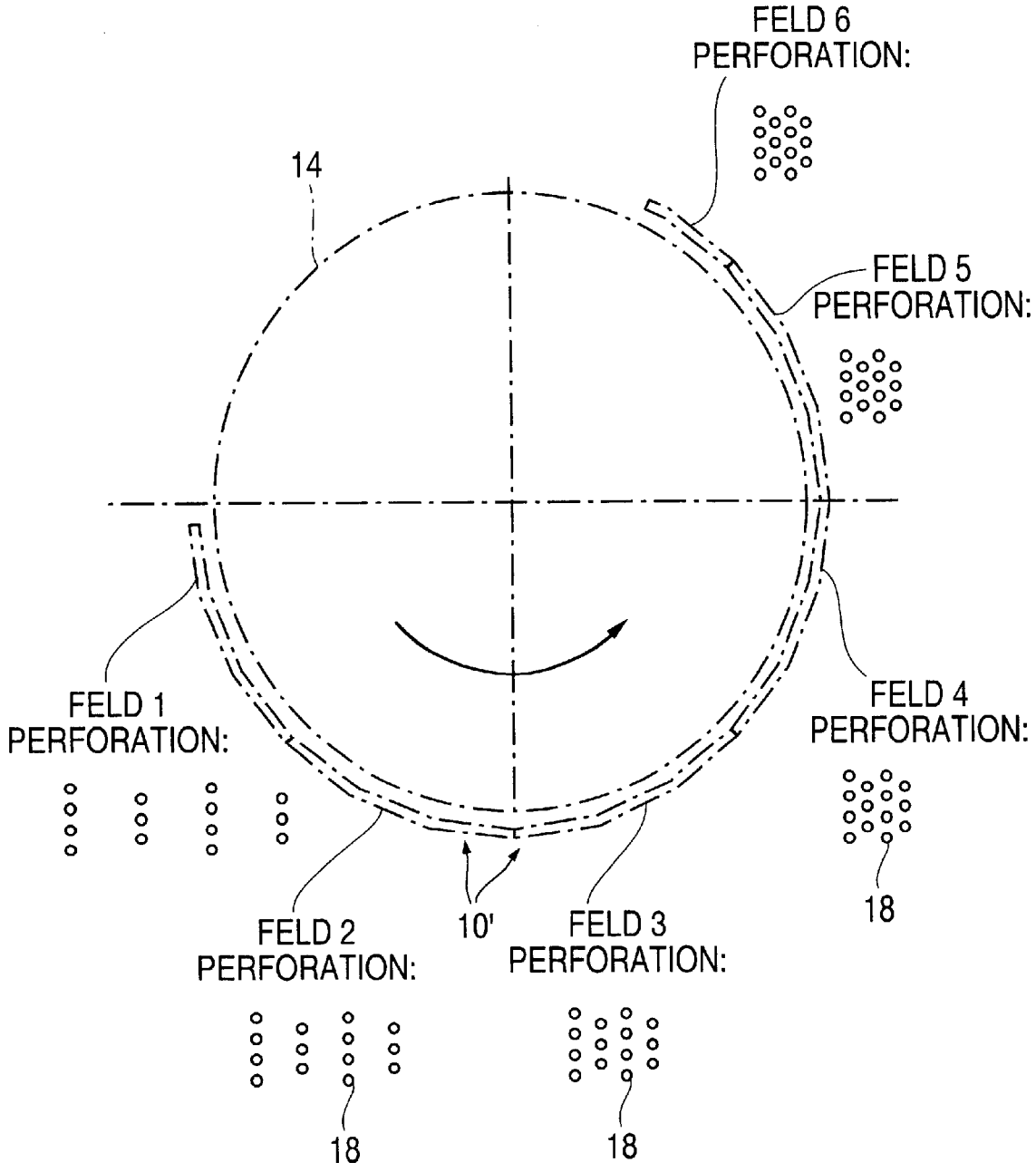
Figure 4:
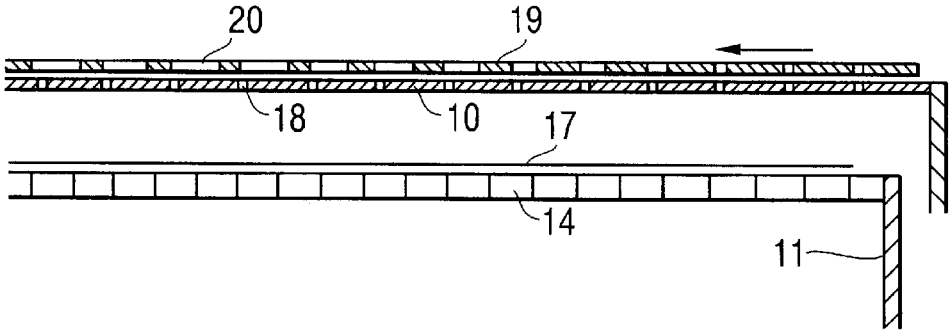
Figure 5:
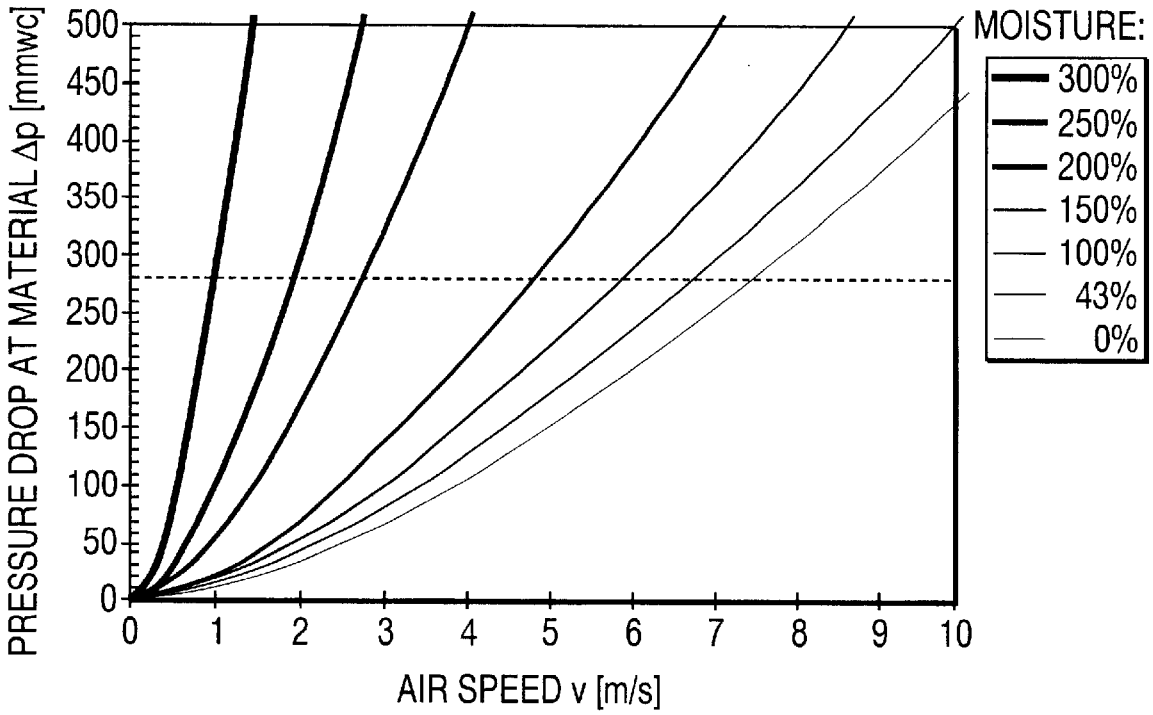

A device of the type according to the invention is shown in the drawings as an example, where:

FIG. 1 is a conventional screen drum design, arranged in series, in a longitudinal section through a drum, FIG. 2 is a screen drum design with only one drum in a cross section through the drum, FIG. 3 is a section, similar to FIG. 2, with a schematically indicated screen cover with its varying perforations over its length, FIG. 4 is a section showing the use of two screen covers, FIG. 5 is a diagram showing pressure drop vs. air speed for varying degrees of moisture, FIG. 6 is a diagram showing the constant $\zeta$ from the Bernoulli's loss equation and air speed plotted against angle at the screen drum, and FIG. 7 shows the actual air speed through the material as a function of the drying phase.

DETAILED DESCRIPTION OF THE INVENTION

A conventional screen drum device consists of a roughly rectangular housing 1 which is divided by a partition 2 into a treatment chamber 3 and a fan chamber 4. In the treatment chamber 3 is the screen drum 5 and, concentrically arranged thereto, in the fan chamber 4 behind a nozzle star 13, a pivoting fan 6. Of course, the fan chamber can also be located in a separate fan housing (not shown here), partitioned off from the screen drum housing 1. This is the event, for instance, with the screen drum design according to FIGS. 2 and 3. In any case, the fan creates a suction draft inside drum 5. According to FIG. 1, above and below fan 6, there are heating units 7 consisting of pipes through which a heating medium flows. In the treatment chamber 3, above and below the screen drum 5, there is a screen cover 10 whose purpose is the retention and thus uniform distribution across the working width of the air coming from fan 6 in front of drum 5. Screen cover 10 defines the area of the incoming air flow surrounding the screen drum, which area, in the case of FIGS. 2 and 3, can also be called a hood. In the area not covered by the textile goods, the screen drum is shielded internally against the suction draft by an inner cover 8 supported on the shaft 14. The drum 5 is wrapped on the outside by a fine-meshed screen 9 which, at the face of the drum, is held taut on the two floors 11, 12.

In FIG. 2, a so-called high-tech screen drum assembly is indicated, where the single screen drum 14 is surrounded by a hood 13 which is supplied by an external fan (not shown) with drying air 16 which flows through screen drum 14. The screen cover 10' concentrically surrounds the screen drum 14 and thus defines the hood 13 in the direction of screen drum 14. In the area not wrapped by the textile goods 17, screen drum 14 is covered against the suction draft by an interior plate 15.

FIG. 3 only shows the screen drum 14, which here turns counterclockwise, and the associated screen cover 10'. The screen cover 10' is divided over its length into several fields which are flat and fastened in segments all around drum 14 at the hood 13. One field 1–6 comprises approximately three segments. The perforation of all the segments shows rows of holes, holes 18, of identical diameter. The difference in fields 1–6 is the distance between the rows of holes. At the beginning of the drying process, at field 1, the distance between the rows of boles is selected so that only a lesser quantity of air can flow through the open surface. At the beginning of the drying process, in other words when the web still contains a great deal of moisture, the resistance to the passage of air is still great; less air is required for the drying process or will flow through the web. But already at field 2, the rows of perforations are closer, and so forth for fields 3 through 6, where the perforation holes provide the largest possible penetration surface due to the smallest possible distance between rows. This screen cover design 10' ensures that, depending on the degree of dryness, screen drum 14 receives exactly as much air as can be passed through the web and drawn in by the drum. No secondary air is created across the opening between the rotating drum and the screen cover fastened to the hood in a stationary manner, and no air flow is created in the circumferential direction of the drum. The result is optimum energy utilization.

FIGS. 2 and 3 show a screen drum design with only one drum 14. The screen cover 10' surrounding drum 14 in a circular fashion is partitioned into segments having varying perforations. This principle can also be applied to a dryer with several drums which, according to FIG. 1, are arranged in series: Here, at the beginning of the drying process, a straight screen cover with less free air passage, and toward the end of the drying process, a screen cover allowing more air to pass through, must be installed. The fans 6 assigned to the front of each screen drum 5 can then be either smaller or larger depending on the location in the dryer, or of identical diameter, but run at lower or higher rotational speeds.

FIG. 4 shows, instead of only one screen cover 10 as shown in FIG. 1, two screen covers 10 and 19 which are located on top of one another and which are displaceable with respect to one another (arrow). The first screen cover 10 is provided over its length in the housing with perforations 18. The second screen cover 19 which runs parallel to the first has another hole structure for partially covering the holes 18 of the first screen cover 10.

What is claimed is:

1. Device for drying permeable webs of goods transported in a transport direction, comprising a housing having at least one rotatably mounted screen drum with a corresponding pumping device at the front end which suctions off the gaseous drying medium from the inside of the screen drum and adds it back to the screen drum from the outside, said screen drum being associated with, on the outside, a stationary screen cover or a fixed cylindrical, screen-like body for equalizing the flow of the oncoming drying medium, characterized in that screen cover over its length in the housing viewed in the transport direction of the goods, is provided with perforations whose open spaces per unit area increase as the degree of dryness of the goods to be dried increases.

2. Device according to claim 1, characterized in that the perforations have a constant diameter over the area of the screen cover , but the distance between the holes decreases with increasing degree of dryness of the goods to be dried.

3. Device according to claim 2, characterized in that the perforations are arranged in rows, with the perforations in each row arranged at a constant distance next to each other, and with increasing degree of dryness of the goods to be dried, the rows of perforations are arranged closer together, one behind the other.

4. Device according to claim 1, characterized in that the screen cover is partitioned over its length into individual segments, and that in each segment, there is a screen cover with a constant free air throughput cross section; and, the subsequent screen cover segment, in the transport direction of the goods, has a greater free air throughput cross section.

5. Device according to claim 4, characterized in that, in each segment, the perforations are arranged in rows, with the perforations in each row arranged at a constant distance next to each other.

6. Device according to claim 1, characterized in that a first screen cover has a constant perforation over its length in the housing, with constant permeability to air, but a second screen cover, arranged parallel to the first one, is provided which, with a different perforation structure, enabling the second cover to partially cover the perforations of the first screen cover in an inlet area of the dryer.

7. Device according to claim 6, wherein the second screen cover is displaceable with respect to the first screen cover.

8. Device according to claim 1, wherein the goods are textile goods.

9. Device according to claim 1, wherein the pumping device is a fan.

* * * * *